US005363974A

United States Patent [19]

Chan

[11] Patent Number: 5,363,974

[45] Date of Patent: Nov. 15, 1994

[54] STACKABLE DESK TRAY ASSEMBLY

[75] Inventor: Eric P. Chan, New York, N.Y.

[73] Assignee: American Trading and Production Corporation, Baltimore, Md.

[21] Appl. No.: 992,786

[22] Filed: Dec. 18, 1992

Related U.S. Application Data

[63] Continuation of Ser. No. 814,282, Dec. 26, 1991, Pat. No. D. 335,505, Ser. No. 814,278, Dec. 26, 1991, Pat. No. D. 335,504, Ser. No. 814,284, Dec. 26, 1991, Pat. No. D. 335,684, Ser. No. 814,914, Dec. 26, 1991, Pat. No. D. 340,068, Ser. No. 814,285, Dec. 26, 1991, Pat. No. D. 336,753, Ser. No. 814,277, Dec. 26, 1991, Pat. No. D. 335,895, Ser. No. 814,919, Dec. 26, 1991, Pat. No. D. 337,618, Ser. No. 814,918, Dec. 26, 1991, Pat. No. D. 341,077, and Ser. No. 814,279, Dec. 26, 1991, Pat. No. D. 349,234.

[51] Int. Cl.[5] ..... A47F 3/14

[52] U.S. Cl. ..... 211/128; 211/11; 206/555

[58] Field of Search ..... 211/128, 126, 194, 11, 211/10; 206/555

[56] References Cited

U.S. PATENT DOCUMENTS

| | | | |
|---|---|---|---|
| D. 120,652 | 5/1940 | Posnack | D19/92 X |
| D. 139,831 | 12/1944 | Posnack | D19/84 X |
| D. 139,832 | 12/1944 | Posnack | D19/92 X |
| D. 179,534 | 1/1957 | Bullock et al. | D19/92 |
| D. 179,652 | 2/1957 | Olson | D19/92 |
| D. 185,130 | 5/1959 | Camilli | D19/78 |
| D. 207,041 | 2/1967 | Goldstein et al. | D80/9 |
| D. 209,882 | 1/1968 | Andersen | D19/75 X |
| D. 226,880 | 5/1973 | Wetmore | D19/76 |
| D. 227,811 | 7/1973 | McFarland | D19/76 |
| D. 234,511 | 3/1975 | Mori | D19/75 |
| D. 239,622 | 4/1976 | Gilomen | D19/76 |
| D. 251,254 | 3/1979 | Tiedmann | D19/90 |
| D. 252,000 | 6/1979 | Smith, III | D06/4 |
| D. 259,428 | 6/1981 | Macowski | D19/92 |
| D. 260,907 | 9/1981 | Giulie et al. | D19/92 |
| D. 266,336 | 9/1982 | Leib, III | D19/76 |
| D. 266,675 | 10/1982 | Polhemus et al. | D19/77 |
| D. 267,414 | 12/1982 | Tyke | D19/92 |
| D. 269,144 | 5/1983 | Mark | D06/4 |
| D. 287,861 | 1/1987 | Husbands | D19/76 |
| D. 288,160 | 2/1987 | Maroney et al. | D06/511 |

(List continued on next page.)

OTHER PUBLICATIONS

Rubbermaid Office Products Group, Inc.; Eldon-Rubbermaid Office Products Catalogue; 1992; Published in U.S.

Tenex Corporation; 100 class/300class Tenex Desk Accessories Brochure; 1990; Published in U.S.

ACCO USA, Inc.; Swingline Desk Accessories and Filing Pockets Brochure 1992; Published in U.S.

*Primary Examiner*—Blair M. Johnson

*Attorney, Agent, or Firm*—Cohn, Powell & Hind

[57] ABSTRACT

A two-tier stackable tray assembly (10) is provided comprising a first and second trays (12,14) including a bottom wall (22) having guide rails (28) and a first U-shaped bracket (1) including a bottom leg (60), a top leg (62) and a bight portion (64). The bracket bottom leg (60) is received by the guide rails (28) of the first tray (12) in snap-fitted relation and the top leg (62) is received by the guide rails (28) of the second tray (14) in snap-fitted relation above the first tray (12). A three tier stackable tray assembly (20) is provided comprising an additional third tray (16) and a second U-shaped bracket (2). The third tray (16) includes a bottom wall (42) having guide rails (49) and the second U-shaped bracket (2) includes a bottom leg (160), a top leg (162) and a bight portion (164). The second bracket bottom leg (160) is received between the first bracket top leg (62) and the second tray (14) in snap-fitted relation and the top leg (162) is received by the guide rails (49) of the third tray (16) in snap-fitted relation above the second tray (14). Another stackable tray assembly (30) is provided by using as a first tier an additional first tray (12) and, as a second tier, an extension tray (18) in conjunction with two first U-shaped brackets (1).

24 Claims, 8 Drawing Sheets

U.S. PATENT DOCUMENTS

| | | | |
|---|---|---|---|
| D. 290,141 | 6/1987 | Rabig | D19/90 |
| D. 292,264 | 10/1987 | Staufenberg et al. | D08/380 |
| D. 298,604 | 11/1988 | Newton | D08/380 |
| D. 302,702 | 8/1989 | Goertz | D19/76 |
| D. 308,077 | 5/1990 | Gecchelin | D19/90 |
| D. 323,188 | 1/1992 | Evenson et al. | D19/20 |
| D. 323,354 | 1/1992 | Nava | D19/78 |
| D. 327,497 | 6/1992 | Szablak et al. | D19/20 |
| D. 327,503 | 6/1992 | Szablak et al. | D19/92 |
| D. 328,103 | 7/1992 | Amabasz | D19/92 |
| D. 330,047 | 10/1992 | Evenson | D19/75 X |
| 2,202,300 | 5/1940 | Posnack | 211/69.1 X |
| 2,472,567 | 6/1949 | Bruen | D19/76 X |
| 3,182,811 | 5/1965 | Bartlett et al. | 211/126 |
| 3,383,786 | 5/1968 | McIntosh | 40/120 |
| 3,482,708 | 12/1969 | Levit et al. | 211/126 |
| 3,533,512 | 10/1970 | Serwer | 211/126 |
| 3,648,849 | 3/1972 | Harris et al. | 211/126 |
| 3,968,881 | 7/1976 | Beil et al. | 211/128 |
| 4,192,425 | 1/1980 | Landau et al. | 211/50 |
| 4,250,639 | 2/1981 | Tarrant | 40/107 |
| 4,253,402 | 3/1981 | Carrig et al. | 211/126 X |
| 4,349,113 | 9/1982 | Schreiner | 211/103 |
| 4,353,470 | 10/1982 | Polhemns et al. | 211/11 X |
| 4,401,222 | 8/1983 | Kulikowski | 211/94 |
| 4,457,088 | 7/1984 | Sharber | 40/120 |
| 4,534,475 | 8/1985 | Mayo | 211/126 |
| 4,589,150 | 5/1986 | Sciabarassi | 4/656 |
| 4,657,148 | 4/1987 | Heng | 211/128 |
| 4,703,703 | 11/1987 | Taub | 211/126 X |
| 4,785,939 | 11/1988 | Huerto et al. | 206/511 |
| 4,838,422 | 6/1989 | Gregerson | 206/555 X |
| 4,887,724 | 12/1989 | Pielechowski et al. | 211/11 |
| 4,907,703 | 3/1990 | Alger et al. | 211/126 X |
| 5,048,698 | 9/1991 | Konrad | 211/45 |
| 5,054,629 | 10/1991 | Breen | 211/128 |

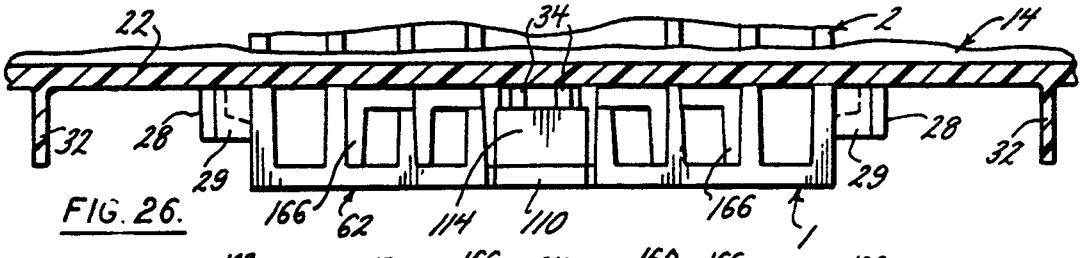
FIG. 26.
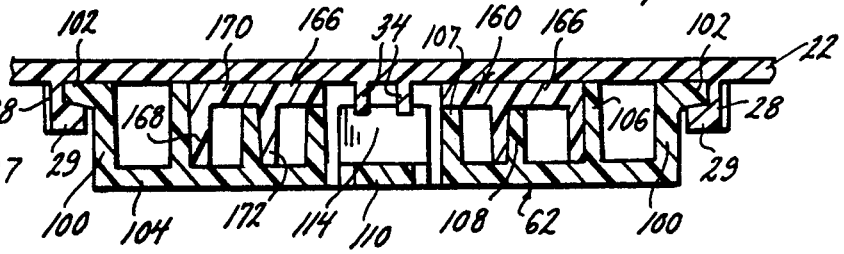
FIG. 27
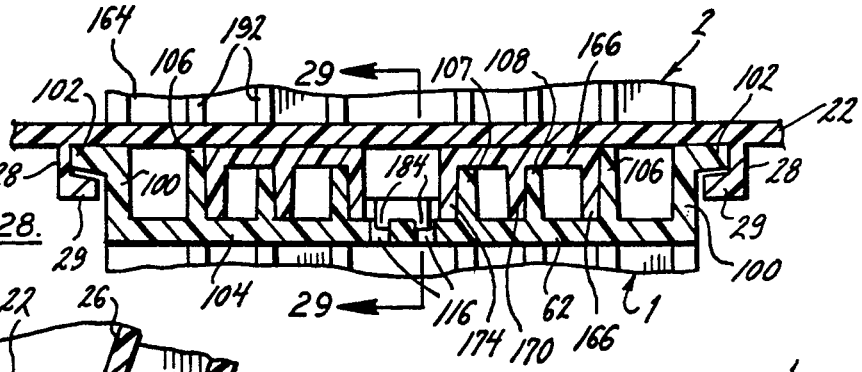
FIG. 28.
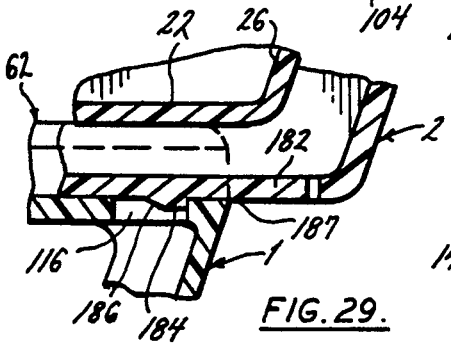
FIG. 29.
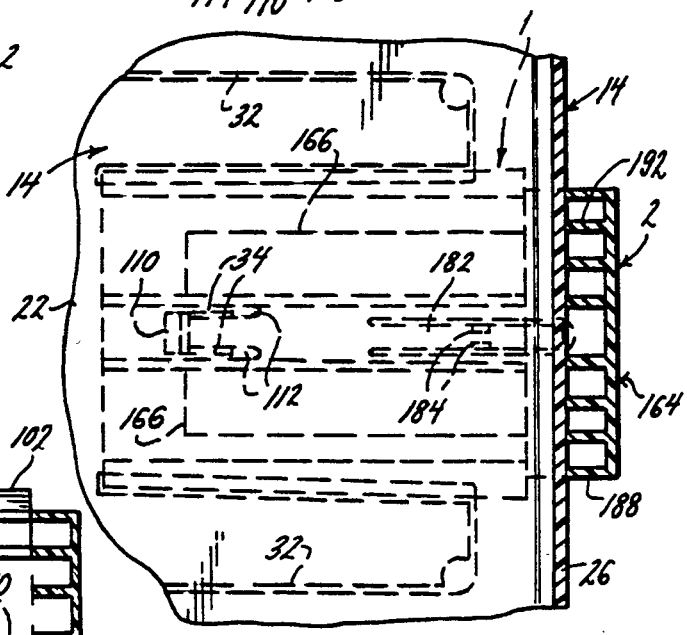
FIG. 24.
FIG. 25.
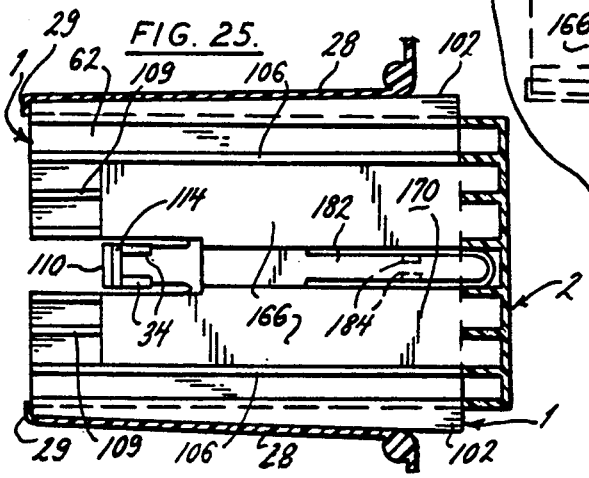

STACKABLE DESK TRAY ASSEMBLY

RELATED U.S. APPLICATION DATA

This invention is related to the following U.S. design applications as a continuation application:

U.S. patent application No. 07/814,282 filed Dec. 29, 1991, U.S. Pat. No. D335,505

U.S. patent application No. 07/814,278 filed Dec. 29, 1991, U.S. Pat. No. D335,504

U.S. patent application No. 07/814,284 filed Dec. 29, 1991, U.S. Pat. No. D335,684

U.S. patent application No. 07/814,914 filed Dec. 29, 1991, U.S. Pat. No. D340,068

U.S. patent application No. 07/814,285 filed Dec. 29, 1991, U.S. Pat. No. D336,753

U.S. patent application No. 07/814,277 filed Dec. 29, 1991, U.S. Pat. No. D335,895

U.S. patent application No. 07/814,919 filed Dec. 29, 1991, U.S. Pat. No. D337,618

U.S. patent application No. 07/814,918 filed Dec. 29, 1991, U.S. Pat. No. D341,077

U.S. patent application No. 07/814,279 filed Dec. 29, 1991, U.S. Pat. No. D349,234

BACKGROUND OF THE INVENTION

This invention relates generally to desk accessories and particularly to a stackable tray assembly.

This stackable tray assembly is related to seven tray designs and two bracket designs which are listed below and can be used as components in the assembly.

Interlocking Stacking Desk Tray
Card File Unit
Calendar Holder
Memo Holder/Stand
Memo Unit
Desk Organizer
Extension Tray
Bracket (A)
Bracket (B)

All of the above design applications are incorporated herein by reference.

Stackable desk tray assemblies are known which utilize posts for connecting individual component trays together. Such assemblies tend to be expensive, complicated and not particularly stable. In addition, the posts tend to obstruct access to the lower trays.

This stackable desk tray assembly avoids the above and other disadvantages in a manner not disclosed in the known prior art.

SUMMARY OF THE INVENTION

This invention provides a stackable tray assembly in which at least two tiers of trays are connected together and spaced from each other by U-shaped brackets.

It is an aspect of this invention to provide a stackable tray assembly comprising a first tray including a bottom wall having connection means, a second tray disposed above the first tray including a bottom wall having connection means, and a first U-shaped bracket including a bottom leg, a top leg and a bight portion, said bottom leg having connection means cooperating with the connection means of said first tray to connect said bottom leg to said first tray, said top leg having connection means cooperating with the means of the second tray to connect said top leg to said second tray, and said bight portion selectively spacing said second tray above said first tray.

It is another aspect of this invention to provide that a third tray is disposed above the second tray including a bottom wall having connection means, a second U-shaped bracket is provided including a bottom leg, a top leg and a bight portion, said bottom leg being received between the underside of the second tray and the top leg of said first bracket and connected thereto, said top leg having connection means cooperating with the connection means of the third tray to connect said top leg to said third tray, and said bight portion selectively spacing said third tray above said second tray.

It is another aspect of this invention to provide that another first tray is disposed in side-by-side relation adjacent to the first tray, another first U-shaped bracket is connected to said other first tray, and said second tray bottom wall is elongate and includes another connection means, said other connection means being adapted to receive and connect the top leg of said other bracket to tie said first trays together.

It is an aspect of this invention to provide a stackable tray assembly comprising a first tray including a bottom wall having guide means and latching means, a second tray disposed above the first tray including a bottom wall having guide means and latching means, and a first U-shaped bracket including a bottom leg, a top leg and a bight portion, said bottom leg having means received by the guide means of the first tray and having latching means cooperating with the latching means of said first tray, said top leg having means received by the guide means of the second tray and having latching means cooperating with the latching means of the second tray, and said bight portion selectively spacing said second tray above said first tray.

It is another aspect of this invention to provide that a third tray is disposed above the second tray including a bottom wall having guide means and latching means, and a second U-shaped bracket is provided including a bottom leg, a top leg and a bight portion, said bottom leg being received between the second tray and the top leg of said first bracket and connected thereto, said top leg having means received by the guide means of the third tray and having latching means cooperating with the latching means of the third tray to connect said top leg to said third tray, and said bight portion selectively spacing said third tray above said second tray.

It is still another aspect of this invention to provide that another first tray is disposed in side-by-side relation adjacent to the first tray, another first U-shaped bracket is connected to said other first tray, and said second tray bottom wall is elongate and includes another guide means and latching means, said second guide means being adapted to receive and connect the top leg of said other bracket to tie said first trays together.

It is an aspect of this invention to provide a stackable tray assembly comprising a first tray including a bottom wall having an underside with a pair of opposed guide rails formed thereon and latching means disposed between said rails, a second tray disposed above the first tray including a bottom wall having an underside with a pair of opposed guide rails formed thereon and latching means disposed between said rails, and a first U-shaped bracket including a bottom leg, a top leg and a bight portion, said bottom leg having opposed side rails received between the guide rails of the first tray and having latching means therebetween cooperating with the latching means of said first tray to snap connect said bottom leg to said first tray, said top leg having opposed side rails received between the guide rails of the second tray and having latching means therebetween cooperating with the latching means of the second tray to snap connect said top leg to said second tray, and said bight portion selectively spacing said second tray above said first tray.

It is another aspect of this invention to provide that a third tray is disposed above the second tray including a bottom wall having an underside with opposed guide rails formed thereon and latching means disposed between said rails, and a second U-shaped bracket is provided including a bottom leg, a top leg and a bight portion, said bottom leg being received between the underside of the second tray and the top leg of said first bracket to snap-connect, said top leg having opposed side rails received between the guide rails of the third tray and having latching means therebetween cooperating with the latching means of the third tray to snap connect said top leg to said third tray, and said bight portion selectively spacing said third tray above said second tray.

It is still another aspect of this invention to provide that another first tray is disposed in side-by-side relation adjacent to the first tray, another first U-shaped bracket is snap-connected to said other first tray, and said second tray bottom wall is elongate and includes another pair of opposed guide rails formed thereon and latching means disposed between said rails, said second pair of guide rails being adapted to receive and snap-connect the top leg of said other bracket to tie said first trays together.

It is yet another aspect of this invention to provide that the first and second trays include a front end and a rear end, and the guide rails of said first and second trays converge toward said front end.

It is an aspect of this invention to provide that the top and bottom legs of the first and second brackets include a front end and a rear end, and the side rails of said top and bottom legs converge toward said front end.

It is another aspect of this invention to provide that the top leg of the first U-shaped bracket includes a portion spaced from the bottom wall of the second tray and including latching means, and the bottom leg of the second U-shaped bracket includes latching means cooperating with the latching means of said top leg of said first U-shaped bracket means and with said second tray to snap-connect said second U-shaped bracket bottom leg to said first U-shaped bracket top leg.

It is still another aspect of this invention to provide that the latching means of at least one of the trays includes a camming face and an abutment face, the latching means of the U-shaped bracket leg connected to said tray includes a resilient tongue flexed by said camming face and engageable by said abutment face to prevent relative movement of said tray in one direction.

It is yet another aspect of this invention to provide that said tray includes stop means engageable with said bracket to prevent relative movement of said tray in the other direction.

It is an aspect of this invention to provide that said latching means of said first and second trays includes a camming face and an abutment face, the first U-shaped bracket bottom leg includes a web and a plurality of ribs, said web forming a resilient tongue providing said bottom leg latching means and being resiliently movable by said camming face and engageable by said abutment face of the first tray latching means to prevent relative movement of said tray in one direction, and the first U-shaped bracket top leg includes a web and a plurality of ribs, said web forming a resilient tongue providing said top leg latching means and being resiliently movable by said camming face and engageable by said abutment face of said second tray latching means to prevent relative movement of said tray in one direction.

It is another aspect of this invention to provide that engagement of said first tray with said bight portion of said first U-shaped bracket prevents relative movement of said tray in said other direction.

It is still another aspect of this invention to provide that said second tray includes stop means and engagement of said first U-shaped bracket top leg with said stop means prevents relative movement of said tray in said other direction.

It is yet another aspect of this invention to provide that said latching means of said first, second and third trays include a camming face and an abutment face, the second U-shaped bracket top leg includes a web and a plurality of ribs said web forming a resilient tongue providing said top leg latching means and being resiliently movable by said camming face and engageable by said abutment face of said third tray latching means to prevent relative movement of said tray in one direction, and the second U-shaped bracket bottom leg includes an intermediate portion and is received in sliding relation between said second tray and said web of said first U-shaped bracket top leg and latching means is provided between said bottom leg intermediate portion and said top leg of said first U-shaped bracket to prevent relative movement of said bracket in one direction.

It is an aspect of the invention to provide that the intermediate portion of said second bracket bottom leg includes a resilient tongue having latching members thereon providing a camming face an abutment face and the web of said first bracket top leg includes slot means receiving said latching members in latched relation.

It is another aspect of this invention to provide that the first U-shaped bracket top leg includes stop means engageable with the bottom leg of the second U-shaped bracket to prevent movement in the other direction.

It is an aspect of this invention to provide that said bight portion of said first U-shaped bracket is rearwardly inclined and another aspect to provide that said bight portion of the second U-shaped bracket is rearwardly inclined.

It is an aspect of this invention to provide stackable tray assemblies which are relatively inexpensive to manufacture, easy to assemble and are highly effective for their intended purpose.

BRIEF DESCRIPTION OF THE DRAWINGS

FIG. 24 is a cross-sectional view taken on line 24–24 of FIG. 17;

FIG. 25 is a cross-sectional view taken on line 25–25 of FIG. 16;

FIG. 26 is an enlarged cross-sectional view taken on line 26–26 of FIG. 16;

FIG. 27 is an enlarged cross-sectional view taken on line 27—27 of FIG. 16;

FIG. 28 is an enlarged cross-sectional view taken on line 28—28 of FIG. 16;

FIG. 29 is a cross-sectional view taken on line 29—29 of FIG. 28;

DESCRIPTION OF THE PREFERRED EMBODIMENT

Figure 1:
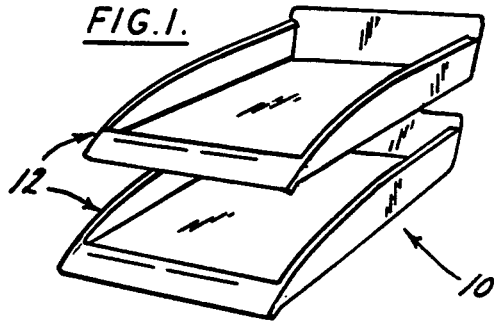
FIG. 1 is a perspective view of a two tier tray assembly.
Figure 2:
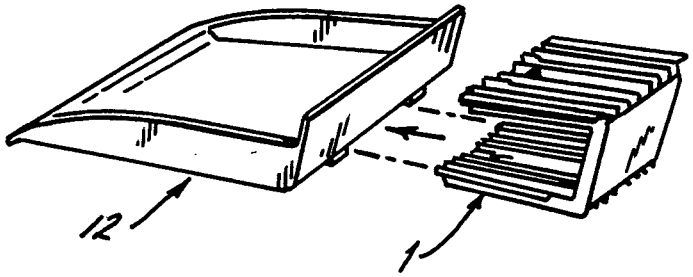
FIG. 2 is a perspective view of the first stage of the assembly process.
Figure 3:
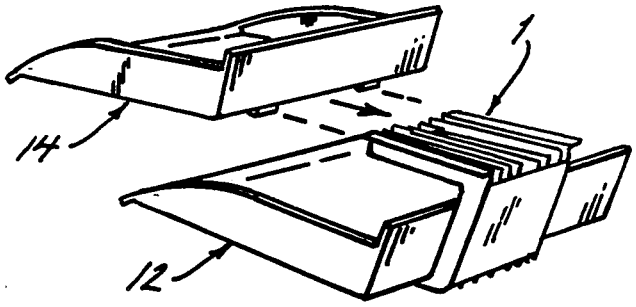
FIG. 3 is a perspective view of the second stage of the assembly process.
Figure 4:
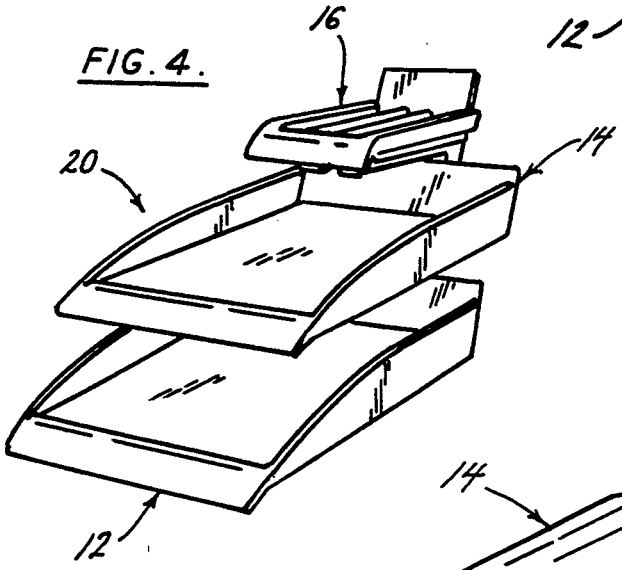
FIG. 4 is a perspective view of a three tier tray assembly incorporating the two tier tray assembly.

Referring now by reference numerals to the drawings and first to FIGS. 1–10 it will be understood that three stacked desk tray assemblies are shown represented by FIGS. 1–3; FIGS. 4–7 and FIGS. 8–10.

In the first assembly, indicated by numeral 10 and shown in FIGS. 1–3, there are two similar trays 12 and 14, interconnected by a first U-shaped bracket 1 to form two tiers.

The second assembly indicated by numeral 20 and shown in FIGS. 4–7, is the same as the first assembly 10 with respect to the first two tiers provided by trays 12 and 14 interconnected by bracket 1 but includes, in addition, a third tier provided in the embodiment shown, by a smaller tray such as a card index tray 16 which is connected to the second tray 14 by a second U-shaped bracket 2.

Figure 8:
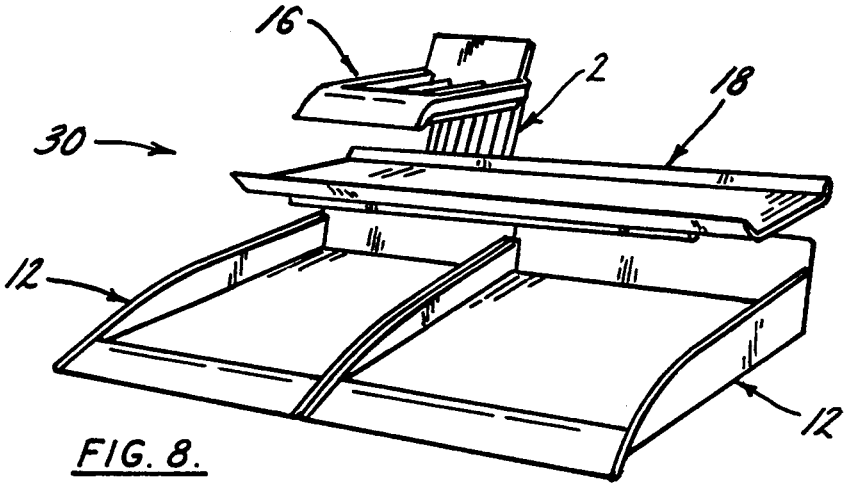
FIG. 8 is a perspective view of another three tier system.
Figure 9:
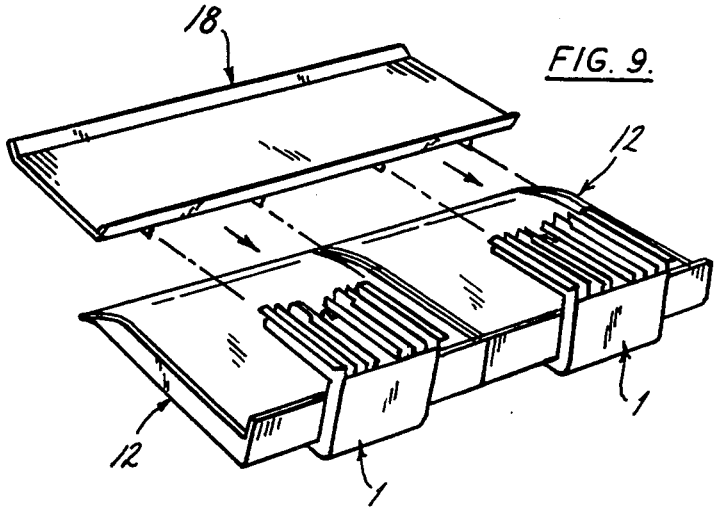
FIG. 9 is a perspective view of a second stage of the assembly process.
Figure 10:
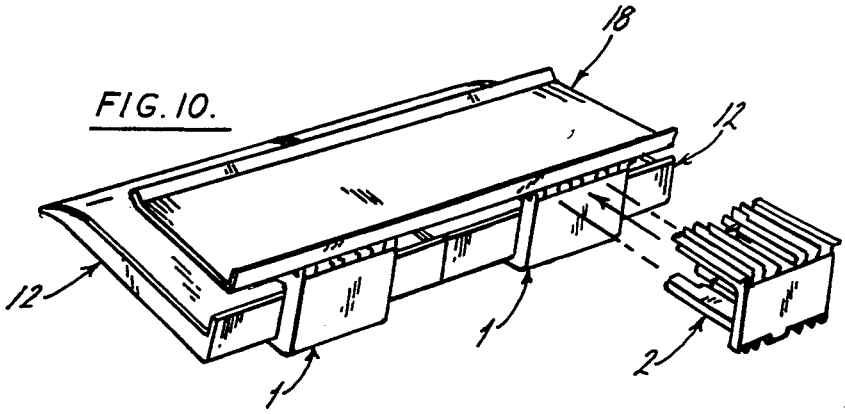
FIG. 10 is a perspective view of a third stage of the assembly process.

The third assembly indicated by numeral 30 and shown in FIGS. 8–10 includes, as a first tier, two trays 12 disposed in side-by-side relation, as a second tier an extension tray 18 connected to each of the trays 12 by a first U-shaped bracket 1 and, as a third tier, the card index tray 16.

In the embodiments shown the tray components 12,14,16 and 18 and the U-shaped brackets 1 and 2 are preferably molded from a plastic material.

As will be readily understood from the brief description given above, the second assembly 20 incorporates the first assembly 10. Accordingly, the components of the second assembly 20 will now be described and first with reference to FIGS. 11–17.

The two trays 12 and 14 are, in the embodiment shown, identical and therefore will be described only with respect to tray 12. Tray 12, which is symmetrical, includes a bottom wall 22, side walls 24 and a rear wall 26. The underside of the bottom wall 22 is formed to provide a pair of opposed guide rails 28 disposed in side-by-side relation but converging slightly to the front from the rear. Guide rails 28 are integrally formed with deeper L-shaped seating rails 32 and the guide rails 28 are provided with inwardly turned legs 29 and end stops 27.

The underside of the bottom wall 22 is also formed to provide a pair of opposed latching elements 34 having rearwardly inclined camming faces 36 and an abutment face 37. The guide rails 28 cooperate with the latching elements 34 to provide a snap-fitting connection between the U-shaped brackets and the trays as will be discussed later.

The third tier tray 16, which is symmetrical, also includes a bottom wall 42, side walls 44, a rear wall 46 and, in addition, card-receiving rails 47. Similarly, the underside of the bottom wall 42 is formed to provide a pair of opposed guide rails 48 disposed in side-by-side relation and likewise converging slightly to the front from the rear. Guide rails 48 also have inwardly turned, though lengthwise intermittent, legs 49 end stops 47 and latching elements 54 with camming faces 56 and abutment faces 57.

Figure 12:
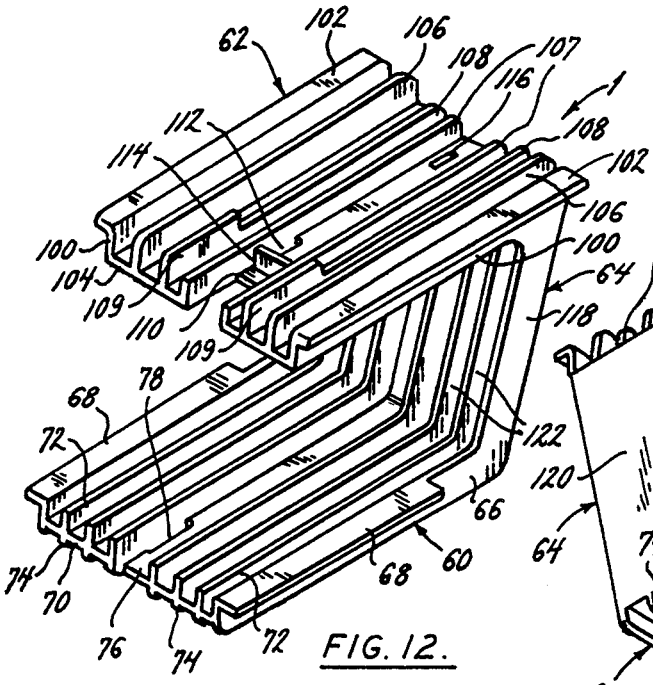
FIG. 12 is a front perspective view of the first bracket.
Figure 13:
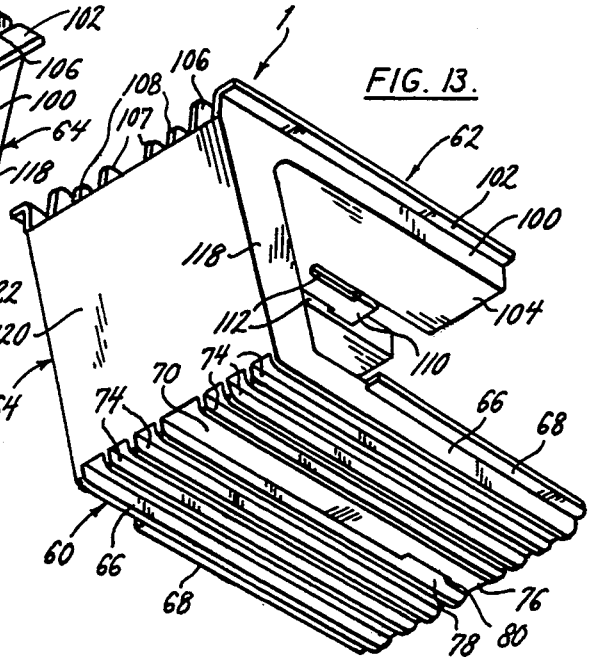
FIG. 13 is a rear perspective view of said bracket.

The first U-shaped bracket 1, which interconnects trays 12 and 14, is best shown in FIGS. 12 and 13. As shown, said bracket 1, which is symmetrical, includes a bottom leg 60, a top leg 62 and a rearwardly inclined bight portion 64. The bottom leg 60 includes outer members 66 providing outwardly extending flanges 68 converging toward the front and a connecting web 70 having a plurality of upper and lower ribs 72 and 74 respectively, said web defining a separated resilient separated tongue 76 having side notches 78, said tongue extending to the rear of notches 78 and said front end of said notches providing a stop 80. The top leg 60 includes outer members 100 providing outwardly extending flanges 102 converging toward the front and a connecting web 104 having a plurality of upper ribs including outer ribs 106, shorter inner ribs 107 and intermediate ribs 108 providing end stops 109, said web defining a resilient separated central tongue 110 having side notches 112 and an upstanding stop 114, said tongue extending to the rear of notches 112. At the opposite end to the tongue 110 the web 104 includes a pair of slots 116. The bight portion 64 is provided with outer members 118 integrally formed with outer members 66 and 100, and connected by a web 120 having a plurality of ribs 122 integrally formed with said bottom leg ribs 72.

The convergence of the guide rails and the received bracket leg side rails facilitates insertion of the bracket legs since the distance between the rear end of the guide rails is considerably greater than the distance between the forward end of the side rails.

Figure 14:
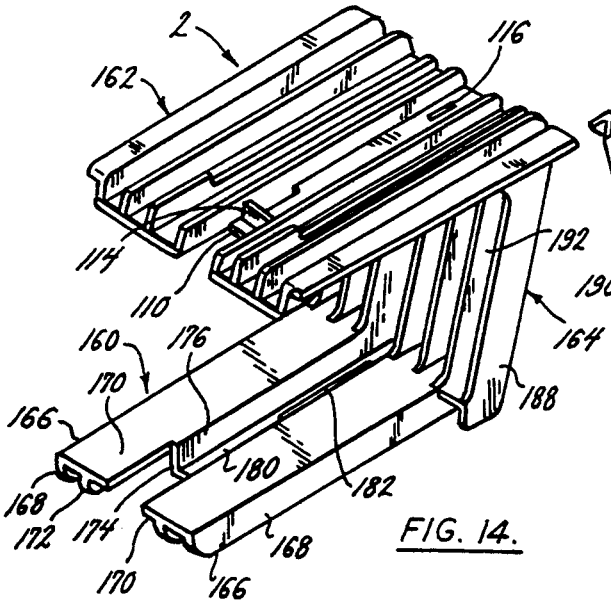
FIG. 14 is a front perspective view of the second bracket.
Figure 15:
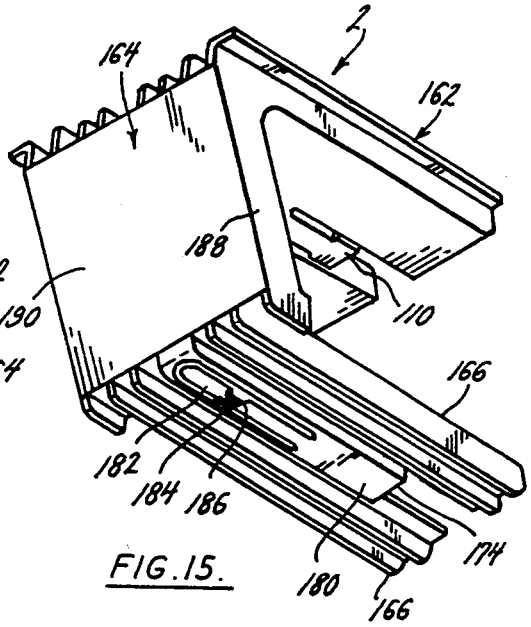
FIG. 15 is a rear perspective view of said bracket.

The second U-shaped bracket 2, which interconnects trays 14 and 16, is best shown in FIGS. 14 and 15. As shown, said bracket 2, which is symmetrical, includes a bottom leg 160, a top leg 162 and a rearwardly inclined bight portion 164. The bottom leg 160 includes opposed finger-like portions 166 formed from outer members 168, webs 170 and inner ribs 172. The finger-like portions 166, are interconnected by an integrally formed immediate, trough-like portion 174 disposed intermediate said finger-like portions 166 which include sidewalls 176 and a bottom web 180. The bottom web 180 includes a separated resilient tongue 182 formed from a U-shaped cutout and having opposed downwardly depending latching elements 184 provided with camming faces 186 and an abutment face 187.

In the embodiment shown, the top leg 162 is identical with the top leg 62 of the first U-shaped bracket 1, and identical numbers are used to describe identical parts. The bight portion 164 is similar to the bight portion 64 of the first U-shaped bracket 1, except for the lower ends of the outer members 188, web 190 and intermediate ribs 192 which are connected to the webs 170 of the bottom leg finger-like portions 166.

Figure 33:
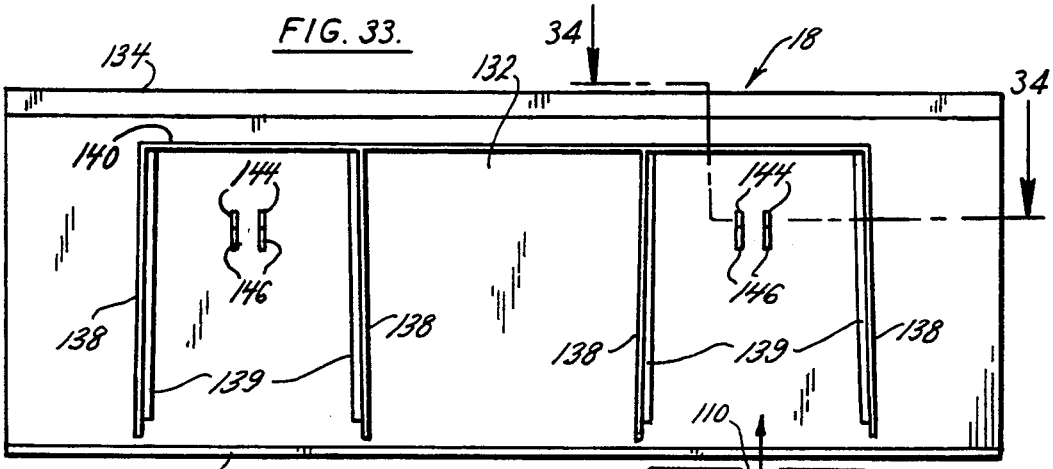
FIG. 33 is a plan view of the extension tray.
Figure 34:
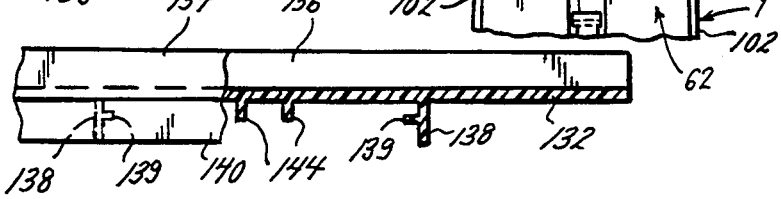
FIG. 34 is a cross-sectional view taken on line 34—34 of FIG. 33.
Figure 11:
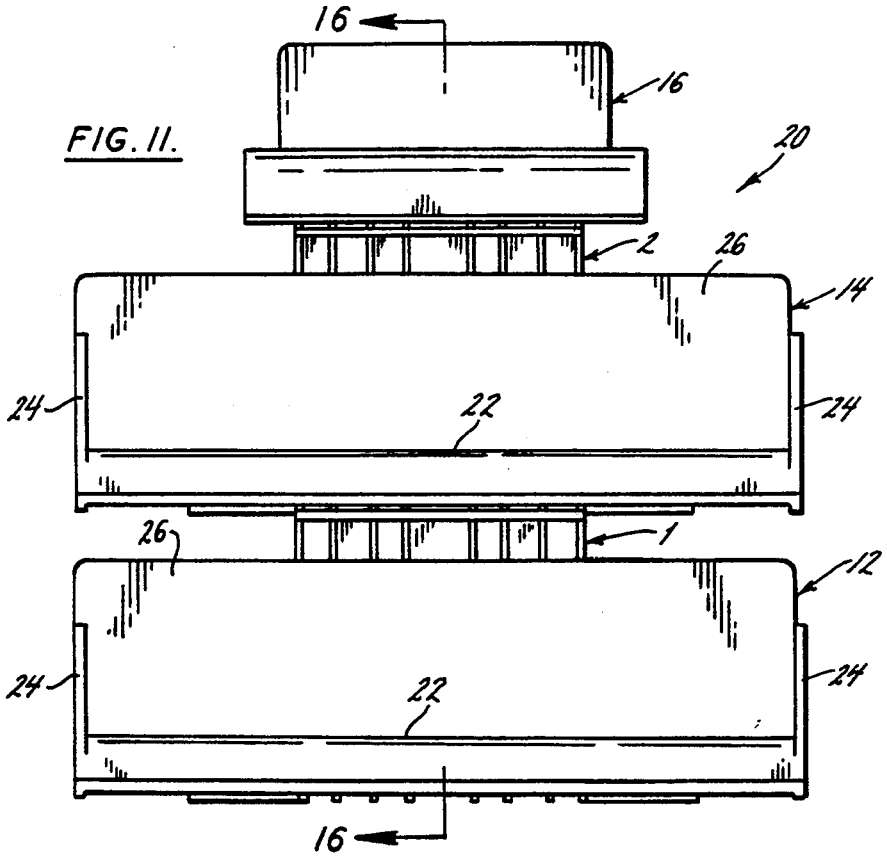
FIG. 11 is a front elevational view of a three tier assembly of FIG. 4.

The third assembly 30 utilizes two abutting trays 12 in side-by-side relation as a first tier, said first tier being interconnected to the second tier extension tray 18 by two U-shaped brackets 1. The extension tray 18, as shown in FIGS. 33 and 34 includes a flat bottom wall portion 132 and upturned front and rear edge portions 134 and 136. The underside of the bottom wall portion 132 is formed to provide two sets of opposed guide rails 138 disposed in side-by-side relation but converging slightly to the front from the rear. Guide rails 138 are integrally formed with front rails 140 and the guide rails are provided with inwardly turned legs 139. The bottom wall portion 132 is also formed to provide two pairs of opposed latching elements 144 having rearwardly inclined camming faces 146 and abutment faces 147. The guide rails 138 cooperate with the latching elements 144 to provide a snap-fitted connection between the upper leg 64 of the U-shaped brackets 1 substantially as discussed above with respect to the connection of bracket 1 with tray 12 in the first tray assembly 10. The spacing of the two sets of rails 138 on the extension tray 18 is such that the trays 12 substantially abut each other when the bracket 1 connection is made. The card index tray 16 is attached to the extension tray 18 by U-shaped bracket 2 as described above with respect to the second tray assembly 20.

It is thought that the structural arrangement of parts of the tray and bracket components forming the three assemblies 10,20 and 30 discussed above will be understood from the foregoing description of parts but for completeness of disclosure the assembly and disassembly of the components will be briefly described.

The assembly 10 shown in FIGS. 1–3 and 16–23 is achieved by first sliding the lower leg 60 of bracket 1 underneath the tray 12, as shown in FIG. 2, so that the guide rails 28 receive the side rails 68 of the bottom leg 60. When the bottom leg 60 is pushed sufficiently into place the resilient tongue 76 engages the camming face 36 of latch element 34 which flexes the tongue so that it rides over the latch element 34 to snap back into engagement with the end abutment 137 of the latching element 34. This engagement prevents forward withdrawal of the tray 12 relative to the bracket bottom leg 60. Rearward movement of the tray 12 is prevented by engagement of the bracket bight portion 64 by the rear wall 26 of the tray 12. The top tray 14 is then pushed rearwardly relative to the top leg 62 of bracket 1, as shown in FIG. 3, so that the guide rails 28 receive the side rails 102 of the top leg 62. When the tray 14 is pushed sufficiently into place the stop 114 of the resilient tongue 110 of the top leg 62 engages the camming face 36 of the latching element 34 which flexes the tongue so that the stop 114 rides over the latching element 34 to snap back into engagement with the end abutment 37 of the latching element 34. This engagement prevents forward withdrawal of the tray 14 relative to the bracket top leg 62. Rearward movement of tray 14 is prevented by engagement with the bight portion 64 of the bracket 1. This completes the tray assembly 10.

Figure 5:
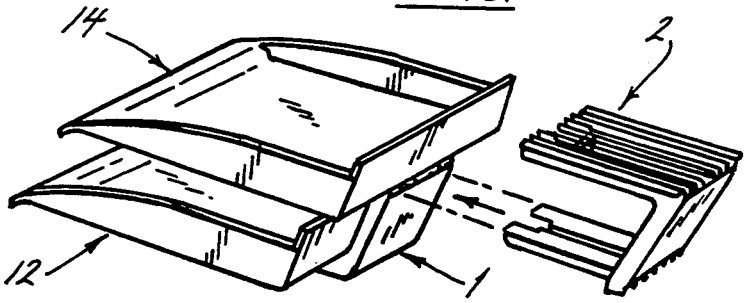
FIG. 5 is a perspective view of the third stage of the assembly process.
Figure 6:
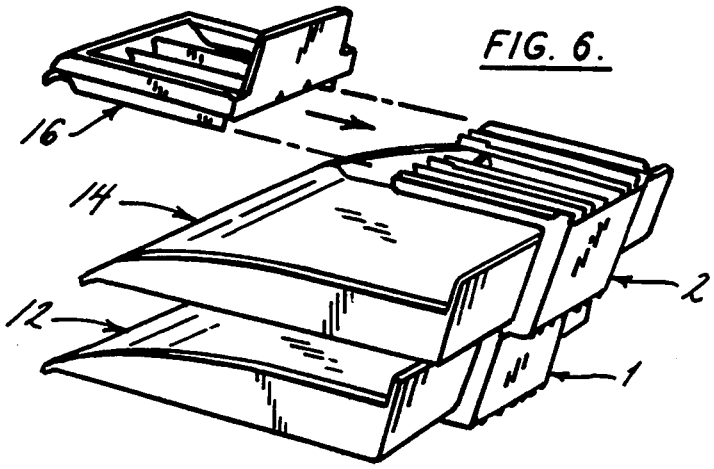
FIG. 6 is a perspective view of the fourth stage of the assembly process.
Figure 16:
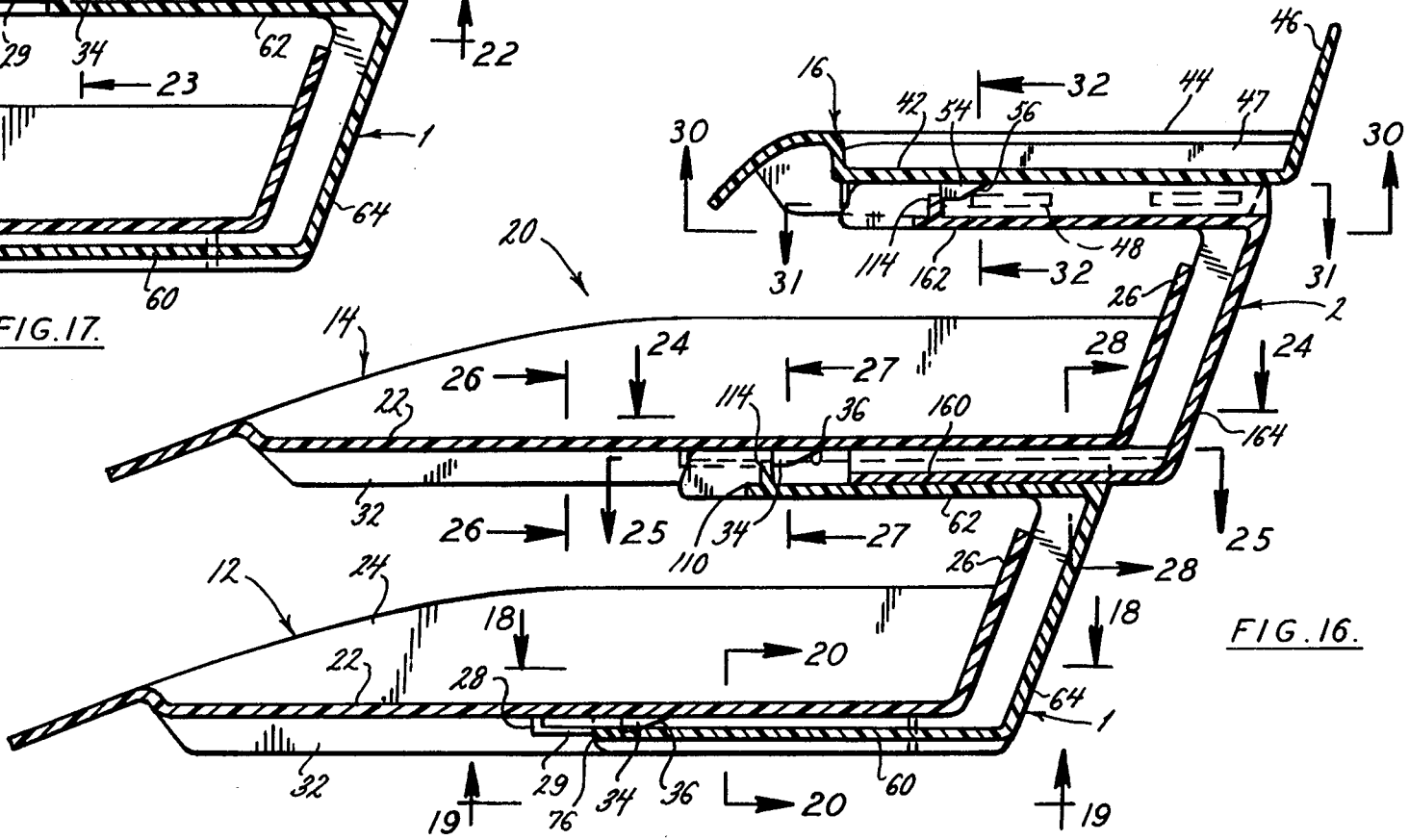
FIG. 16 is a cross-sectional view taken on line 16—16 of FIG. 11.
Figure 17:
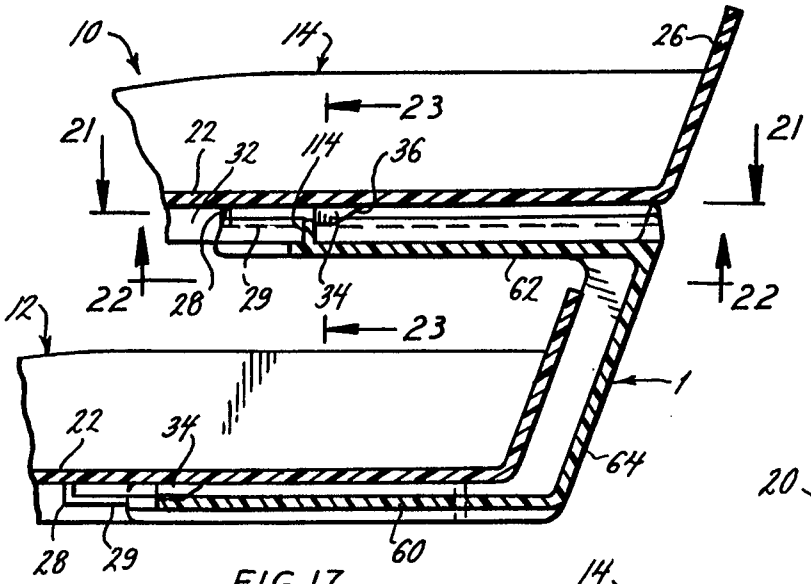
FIG. 17 is a cross-sectional view showing the first and second stages of the assembly of FIG. 16.
Figure 18:
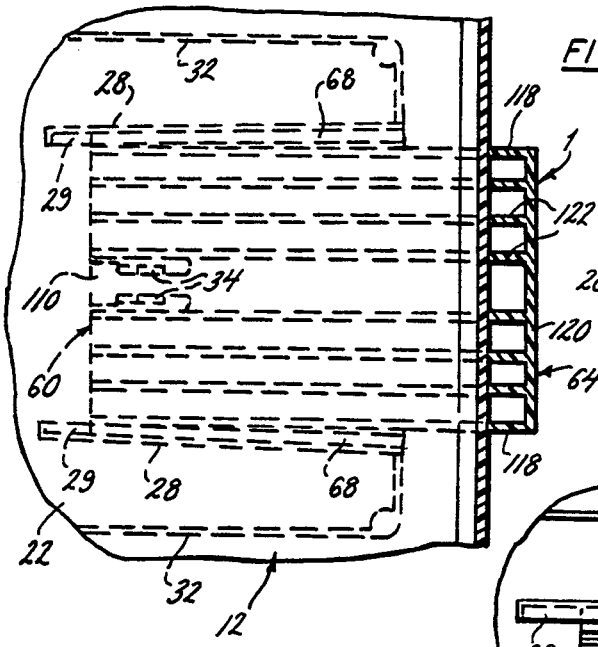
FIG. 18 is a cross-sectional view taken on line 18—18 of FIG. 16.
Figure 20:
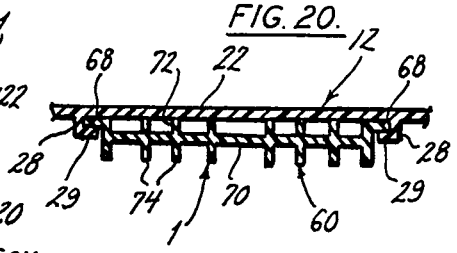
FIG. 20 is a cross-sectional view taken on line 20—20 of FIG. 16.
Figure 19:
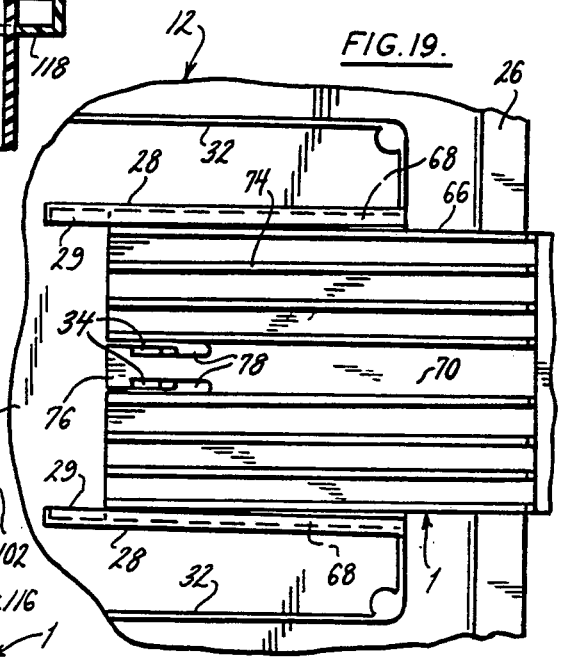
FIG. 19 is a cross-sectional view taken on line 19—19 of FIG. 16.
Figure 21:
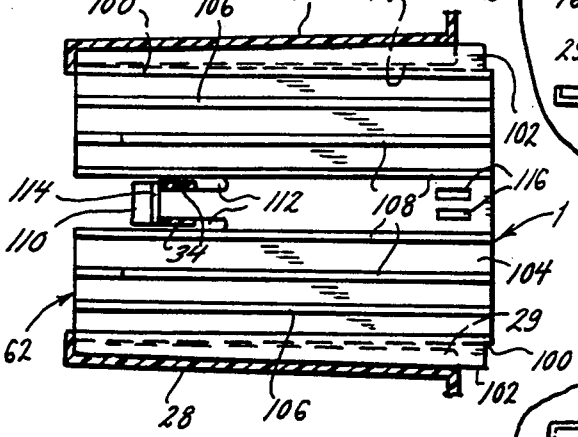
FIG. 21 is a cross-sectional view taken on line 21—21 of FIG. 17.
Figure 23:
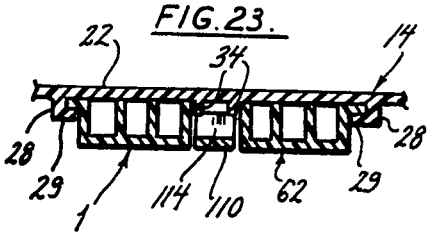
FIG. 23 is a cross-sectional view taken on line 23—23 of FIG. 17.
Figure 22:
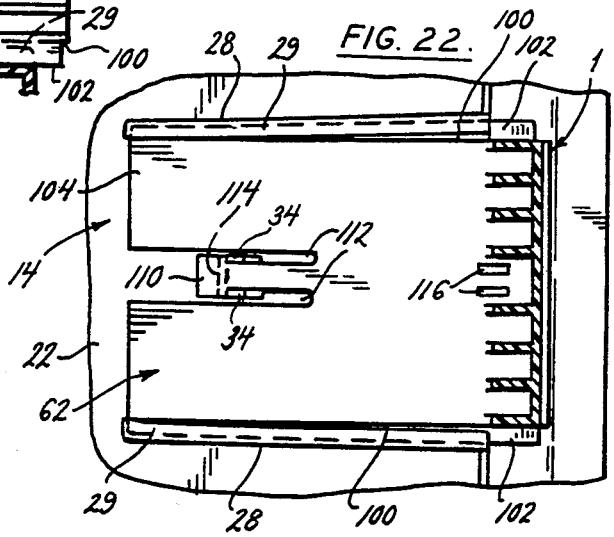
FIG. 22 is a cross-sectional view taken on line 22—22 of FIG. 17.

The completion of tray assembly 20 is shown by additional reference to FIGS. 4–6 and 24–29. As shown, it is first necessary to connect the bottom leg 160 of the bracket 2 to the tray 14 and the bracket 1. This connection is accomplished, as shown in FIGS. 5, 16 and 25, by inserting the bottom leg fingers 166 between tray 14, and the web 104 and the ribs 106 of the top leg 60 of bracket 1 until the ends of the fingers 166 engage the stops 109 provided by the ribs 108 of the top leg 60. Just before this engagement of the bracket 2 bottom leg 160 occurs resilient tongue 182 flexes, see FIG. 29, on engagement of the camming face 186 of the latching elements 184 with the corner 190 of bracket 1 top leg 62 which results in the latching elements 184 being received with latch openings 116 provided in said top leg 62 and engaging the end abutment 187 of said latch elements. This engagement prevents rearward withdrawal of the bracket 2 bottom leg 160 relative to the top leg 62 of bracket 1 and to the tray 14. Forward movement of the lower leg 160 is prevented by engagement of bracket 2 bottom leg 160 with the stop 109 of bracket 1 ribs 108.

Figure 30:
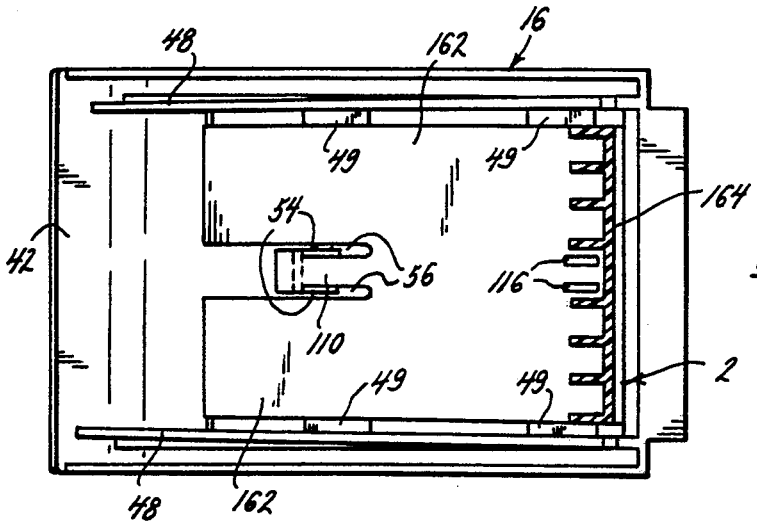
FIG. 30 is a cross-sectional view taken on line 30—30 of FIG 16.
Figure 31:
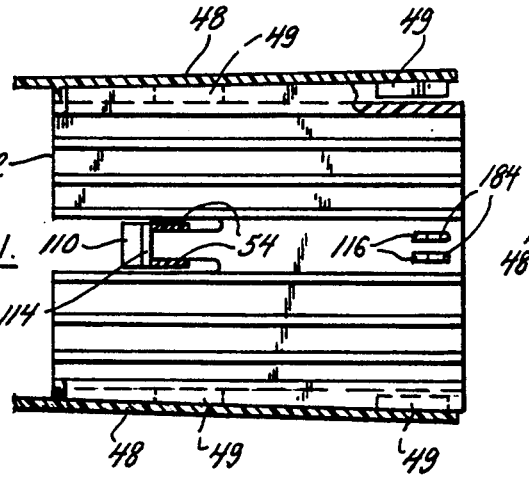
FIG. 31 is a cross-sectional view taken on line 31—31 of FIG. 16.
Figure 32:
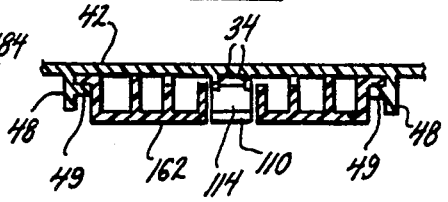
FIG. 32 is a cross-sectional view taken on line 32—32 of FIG. 16.

The assembly of tray 16 is shown by additional reference to FIGS. 30–32. The top leg 162 of bracket 2 is identical with the top leg 62 of bracket 1 and the bottom of the tray 16 is similar to the bottom of the tray 14 except that the guide rails 48 have intermittent outstanding portions 49 which receive the side rails 102 of said bracket 2 top leg 162. Accordingly, when the tray 16 is pushed sufficiently into place the stop 114 of the resilient tongue 110 of the top leg 160 engages the camming face 56 of the latching element 54 which flexes the tongue so that the stop 114 rides over the latching element to snap back into engagement with the end abutment 57 of the latching element 54. This engagement prevents forward withdrawal of the tray 16 relative to the bracket top leg 162. Rearward movement of the tray 16 is prevented by engagement of the stops 47 at the end of the guide rail 48 with the end of the top leg 162 of bracket 2.

The third assembly 30 is best understood by reference to FIGS. 8–10,33 and 34. As shown, this assembly is assembled by connecting the bottom leg 60 of each of two brackets 1 to the bottom of two trays 12 as described above with respect to assembly 10 and by connecting extension tray 18 to each top leg 62 of said brackets 1. This is accomplished in substantially the same manner as described above with respect to tray 14 because each side of the extension tray 18 has comparable pairs guide rails 138 and latching elements 144 with camming faces 146 and end abutments 147 as are provided by tray 14. The engagement of the latching elements with the resilient tongue 110 is similar to that described above with respect to tray 14. This engagement prevents forward withdrawal of the extension tray 18 relative to the bracket top leg 62. Rearward movement of the tray 18 is prevented by engagement of the front wall 140 with the front portion of the bracket top leg 62. The connection of bracket 2 is accomplished as shown in FIG. 10 and is substantially the same as described above with respect to assembly 20. The connection of third tier tray 16 is also accomplished as described above with respect to the second assembly 20.

Figure 7:
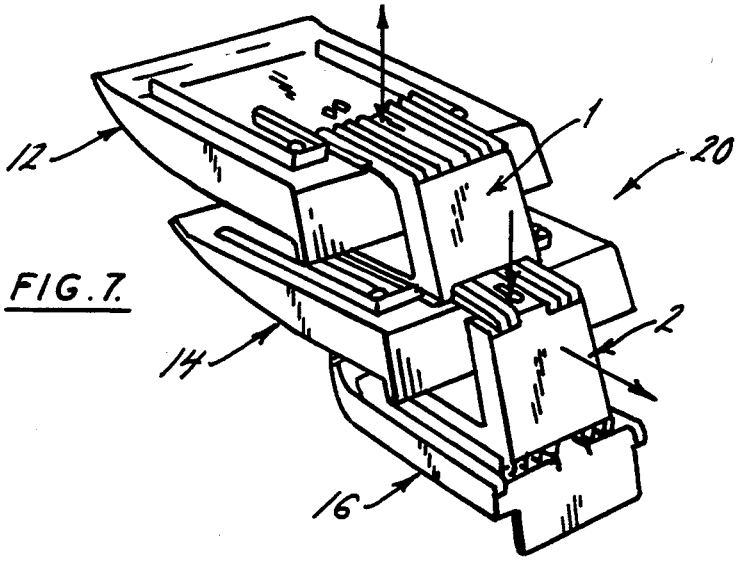
FIG. 7 is an upside down perspective view of the disassembly process.

Disassembly of the various components of assembly 20, by way of example, is shown in FIG. 7 which shows the assembly upside down. Bracket 2 bottom leg 160 is disengaged by digitally depressing resilient tongue 182 of the bottom leg 160 of bracket 2 from openings 116 of the top leg 162 and pulling bracket 2 rearwardly of bracket 1. Tray 12 is disengaged from the bottom leg 60 of bracket 1 by digitally lifting resilient tongue 76 of the bottom leg 60 of bracket 1 and pulling tray 12 forwardly. Tray 14 is disengaged from the top leg 62 of bracket 1 by digitally lifting resilient tongue 110 of top leg 62 of bracket 1 and pulling tray 14 forwardly. Tray 16 is disengaged from the top leg 162 of bracket 2 by digitally lifting resilient tongue 110 of top leg 162 of bracket 2 and pulling tray 16 forwardly.

Assembly 30 is disassembled in much the same way as described above with respect to assembly 20.

With respect to the related design applications listed in the Background of the Invention trays 12 and 14 correspond to the interlocking stackable desk tray. Tray 16 corresponds to the card file unit but could also be the calendar holder, memo holder/stand, memo unit or desk organizer. Tray 18 corresponds to the extension tray. Bracket 1 and bracket 2 correspond to brackets A and B respectively.

It will be understood that the second tier tray is not limited to an identical tray but could also be one of the group referred to above as corresponding to tray 16.

In addition, because the top leg 162 of the U-shaped bracket 2 is identical to the top leg 62 of the U-shaped bracket 1, it is possible to provide tray assemblies of at least four tray tiers. This is accomplished by connecting the bottom leg 160 of another U-shaped bracket 2 between the tray 16 and the top leg 162 of the original U-shaped bracket 2, as shown in phantom outline in FIG. 16. Another tray 16 (not shown) can then be connected to the top leg 162 of the second U-shaped bracket 2. This is possible because all of the trays 12,14,16 and 18 are connectable to the top leg of U-shaped bracket 2.

Accordingly, although the improved stackable tray assemblies have been described by making particular reference to preferred sets of bracket and tray combination, the details of description are not to be understood as restrictive, numerous variants being possible within the principles disclosed and within the fair scope of the claims hereunto appended.

I claim as my invention:

1. A stackable tray assembly comprising:

a first tray including a bottom wall having connection means, a second tray disposed above the first tray including a bottom wall having connection means, and a first U-shaped bracket including a bottom leg, a top leg and a bight portion, 1) said bottom leg having-connection means cooperating with the connection means of said first tray to connect said bottom leg to said first tray, 2) said top leg having connection means cooperating with the connection means of the second tray to connect said top leg to said second tray, and 3) said bight portion selectively spacing said second tray above said first tray said bight portion being disposed at one end only of said trays to provide clear access at the other end of said trays, said first and second trays having a front end and a rear end and said bottom and top legs of said first bracket extending from said rear end toward said front end of said connected trays.

2. A stackable tray assembly as defined in claim 1, in which:

a third tray is disposed above the second tray including a bottom wall having connection means, a second U-shaped bracket is provided including a bottom leg, a top leg and a bight portion, 1) said bottom leg being received between the underside of the second tray and the top leg of said first bracket and connected thereto, 2) said top leg having connection means cooperating with the connection means of the third tray to connect said top leg to said third tray, and 3) said bight portion selectively spacing said third tray above said second tray said bight portion being disposed at one end only of said trays to provide clear access at the other end of said trays, said third tray having a front end and a rear end and said bottom and top legs of said second bracket extending from said rear end toward said front end of said connected trays.

3. A stackable tray assembly comprising:

a first tray including a bottom wall having connection means, a second tray disposed above the first tray including a bottom wall having connection means, and a first U-shaped bracket including a bottom leg, a top leg and a bight portion, 1) said bottom leg having connection means cooperating with the connection means of said first tray to connect said bottom leg to said first tray, 2) said top leg having connection means cooperating with the connection means of the second tray to connect said top leg to said second tray, and 3) said bight portion selectively spacing said second tray above said first tray, another first tray being disposed in side-by-side relation adjacent to the first tray, another first U-shaped bracket being connected to said other first tray, and said second tray bottom wall being elongate and including another connection means, said other connection means being adapted to receive and connect the top leg of said other bracket to tie said first trays together.

4. A stackable tray assembly comprising:

(a) a first tray including a bottom wall having guide means and latching means, (b) a second tray disposed above the first tray including a bottom wall having guide means and latching means, and (c) a first U-shaped bracket including a bottom leg, a top leg and a bight portion, 1) said bottom leg having means received by the guide means of the first tray and having latching means cooperating with the latching means of said first tray, 2) said top leg having means received by the guide means of the second tray and having latching means cooperating with the latching means of the second tray, and 3) said bight portion selectively spacing said second tray above said first tray said bight portion being disposed at one end only of said trays to provide clear access at the other end of said trays, said first and second trays having a front end and a rear end and said bottom and top .Legs of said first bracket extending from said rear end toward said front end of said connected trays.

5. A stackable tray assembly as defined in claim 4, in which:

a third tray is disposed above the second tray including a bottom wall having guide means and latching means, and a second U-shaped bracket is provided including a bottom leg, a top leg and a bight portion, 1) said bottom leg being received between the second tray and the top leg of said first bracket and connected thereto, 2) said top leg having means received by the guide means of the third tray and having latching means cooperating with the latching means of the third tray to connect said top leg to said third tray, and 3) said bight portion selectively spacing said third tray above said second tray said bight portion being disposed at one end only of said trays to provide clear access at the other end of said trays, said third tray having a front end and a rear end and said bottom and top legs of said second bracket extending from said rear end toward said front end of said connected trays.

6. A stackable tray assembly comprising:

a first tray including a bottom wall having guide means and latching means, a second tray disposed above the first tray including a bottom wall having guide means and latching means, and a first U-shaped bracket including a bottom leg, a top leg and a bight portion, 1) said bottom leg having means received by the guide means of the first tray and having latching means cooperating with the latching means of said first tray, 2) said top leg having means received by the guide means of the second tray and having latching means cooperating with the latching means of the second tray, and 3) said bight portion selectively spacing said second tray above said first another first tray being disposed in side-by-side relation adjacent to the first tray, another first U-shaped bracket being connected to said other first tray, and said second tray bottom wall being elongate and including another guide means and latching means, said second guide means being adapted to receive and connect the top leg of said other bracket to tie said first trays together. –

7. A stackable tray assembly comprising:

a first tray including a bottom wall having an underside with a pair of opposed guide rails formed thereon and latching means disposed between said rails, a second tray disposed above the first tray including a bottom wall having an underside with a pair of opposed guide rails formed thereon and latching means disposed between said rails, and a first U-shaped bracket including a bottom leg, a top leg and a bight portion, 1) said bottom leg having opposed side rails received between the guide rails of the first tray and having latching means therebetween cooperating with the latching means of said first tray to snap connect said bottom leg to said first tray, 2) said top leg having opposed side rails received between the guide rails of the second tray and having latching means therebetween cooperating with the latching means of the second tray to snap-connect said top leg to said second tray, and 3) said bight portion selectively spacing said second tray above said first tray, said first and second trays having a front end and a rear end and said bottom and top legs of said first bracket extending from said rear end toward said front end of said connected trays.

8. A stackable tray assembly as defined in claim 7, in which:

a third tray is disposed above the second tray including a bottom wall having an underside with opposed guide rails formed thereon and latching means disposed between said rails, and a second U-shaped bracket is provided including a bottom leg, a top leg and a bight portion, 1) said bottom leg being received between the underside of the second tray and the top leg of said first bracket in snap-connected relation, 2) said top leg having opposed side rails received between the guide rails of the third tray and having latching means therebetween cooperating with the latching means of the third tray to snap connect said top leg to said third tray, and 3) said bight portion selectively spacing said third tray above said second tray, said third tray having a front end and a rear end and bottom and top legs of said second bracket extending from said rear end toward said front end of said connected trays.

9. A stackable tray assembly comprising:

a first tray including a bottom wall having an underside with a pair of opposed guide rails formed thereon and latching means disposed between said rails, a second tray disposed above the first tray including a bottom wall having an underside with a pair of opposed guide rails formed thereon and latching means disposed between said rails, and a first U-shaped bracket including a bottom leg, a top leg and a bight portion, 1) said bottom leg having opposed side rails received between the guide rails of the first tray and having latching means therebetween cooperating with the latching means of said first tray to snap connect said bottom leg to said first tray, 2) said top leg having opposed side rails received between the guide rails of the second tray and having latching means therebetween cooperating with the latching means of the second tray to snap-connect said top leg to said second tray, and 3) said bight portion selectively spacing said second tray above said first tray, another first tray being disposed in side-by-side relation adjacent to the first tray, another first U-shaped bracket being snap-connected to said other first tray, and said second tray bottom wall being elongate and including another pair of opposed guide rails formed thereon and latching means disposed between said rails, said second pair of guide rails being adapted to receive and snap-connect the top leg of said other bracket to tie said first trays together.

10. A stackable tray assembly comprising:

a first tray including a bottom wall having an underside with a pair of opposed guide rails formed thereon and latching means disposed between said rails, a second tray disposed above the first tray including a bottom wall having an underside with a pair of opposed guide rails formed thereon and latching means disposed between said rails, and a first U-shaped bracket including a bottom leg, a top leg and a bight portion, 1) said bottom leg having opposed side rails received between the guide rails of the first tray and having latching means therebetween cooperating with the latching means of said first tray to snap-connect said bottom leg to said first tray, 2) said top leg having opposed side rails received between the guide rails of the second tray and having latching means therebetween cooperating with the latching means of the second tray to snap-connect said top to said second tray, and 3) said bight portion selectively spacing said second tray above said first tray, the first and second trays including a front end and a rear end, and the guide rails of said first and second trays converging toward said front end.

11. A stackable tray assembly as defined in claim 10 in which:

the top and bottom legs of the first and second brackets include a front end and a rear end, and the side rails of said top and bottom legs converge toward said front end.

12. A stackable tray assembly comprising:

a first tray including a bottom wall having an underside with a pair of opposed guide rails formed thereon and latching means disposed between said rails, a second tray disposed above the first tray including a bottom wall having an underside with a pair of opposed guide rails formed thereon and latching means disposed between said rails, and a first U-shaped bracket including a bottom leg, a top leg and a bight portion, 1) said bottom leg having opposed side rails received between the guide rails of the first tray and having latching means therebetween cooperating with the latching means of said first tray to snap-connect said bottom leg to said first tray, 2) said top leg having opposed side rails received between the guide rails of the second tray and having latching means therebetween cooperating with the latching means of the second tray to snap-connect said top leg to said second tray, and 3) said bight portion selectively spacing said second tray above said first tray, a third tray being disposed above the second tray including a bottom wall having an underside with opposed guide rails formed thereon and latching means disposed between said rails, and a second U-shaped bracket being provided including a bottom leg, a top leg and a bight portion, 1) said bottom leg being received between the underside of the second tray and the top leg of said first bracket in snap-connected relation, 2) said top leg having opposed side rails received between the guide rails of the third tray and having latching means therebetween cooperating with the latching means of the third tray to snap-connect said top leg to said third tray, and 3) said bight portion selectively spacing said third tray above said second tray, the top leg of the first U-shaped bracket including a portion spaced from the bottom wall of the second tray and including latching means, and the bottom leg of the second U-shaped bracket including latching means cooperating with the latching means of said top leg of said first U-shaped bracket means and with said second tray to snap-connect said second U-shaped bracket bottom leg to said first U-shaped bracket top leg.

13. A stackable tray assembly as defined in claim 7, in which:

the latching means of at least one of the trays includes a camming face and an abutment face, the latching means of the U-shaped bracket leg connected to said tray includes a resilient tongue flexed by said camming face and engageable by said abutment face to prevent relative movement of said tray in one direction.

14. A stackable tray assembly as defined in claim 13, in which:

said tray includes stop means engageable with said bracket to prevent relative movement of said tray in the other direction.

15. A stackable tray assembly comprising:

a first tray including a bottom wall having an underside with a pair of opposed guide rails formed thereof and latching means disposed between said rails, a second tray disposed above the first tray including a bottom wall having an underside with a pair of opposed guide rails formed thereon and latching means disposed between said rails, and a first U-shaped bracket including a bottom leg, a top leg and a bight portion, 1) said bottom leg having opposed side rails received between the guide rails of the first tray and having latching means therebetween cooperating with the latching means of said first tray to snap connect said bottom leg to said first tray, 2) said top leg having opposed side rails received between the guide rails of the second tray and having latching means therebetween cooperating with the latching means of the second tray to snap-connect said top leg to said second tray, and 3) said bight portion selectively spacing said second tray above said first said latching means of said first and second trays including a camming face and an abutment face, the first U-shaped bracket bottom leg including a web and a plurality of ribs, said web forming a resilient tongue providing said bottom leg latching means and being resiliently movable by said camming face and engageable by said abutment face of the first tray latching means to prevent relative movement of said tray in one direction, and the first U-shaped bracket top leg including a web and a plurality of ribs, said web forming a resilient tongue providing said top leg latching means and being resiliently movable by said camming face and engageable by said abutment face of said second tray latching means to prevent relative movement of said tray in one direction.

16. A stackable tray assembly as defined in claim 15, in which:

engagement of said first tray with said bight portion of said first U-shaped bracket prevents relative movement of said tray in said other direction.

17. A stackable tray assembly as defined in claim 16, in which:

said second tray includes stop means and engagement of said first U-shaped bracket top leg with said stop means prevents relative movement of said tray in said other direction,

18. A stackable tray assembly comprising:

a first tray including a bottom wall having an underside with a pair of opposed guide rails formed thereon and latching means disposed between said rails, a second tray disposed above the first tray including a bottom wall having an underside with a pair of opposed guide rails formed thereon and latching means disposed between said rails., and a first U-shaped bracket including a bottom leg, a top leg and a bight portion, 1) said bottom leg having opposed side rails received between the guide rails of the first tray and having latching means therebetween cooperating with the latching means of said first tray to snap connect said bottom leg to said first tray, 2) said top leg having opposed side rails received between the guide rails of the second tray and having latching means therebetween cooperating with the latching means of the second tray to snap-connect said top leg to said second tray, and 3) said bight portion selectively spacing said second tray above said first tray, a third tray is disposed above the second tray including a bottom wall having an underside with opposed guide rails formed thereon and latching means disposed between said rails, and a second U-shaped bracket is provided including a bottom leg, a top leg and a bight portion, 1) said bottom leg being received between the underside of the second tray and the top leg of said first bracket in snap-connected relation, 2) said top leg having opposed side rails received between the guide rails of the third tray and having latching means therebetween cooperating with the latching means of the third tray to snap connect said top leg to said third tray, and 3) said bight portion selectively spacing said third tray above said second tray, said latching means of said first, second and third trays including a camming face and an abutment face, the first U-shaped bracket bottom leg including a web and a plurality of ribs, said web forming a resilient tongue providing said bottom leg latching means and being resiliently movable by said camming face and engageable by said abutment face of said first tray latching means to prevent relative movement of said tray in one direction, the first U-shaped bracket top leg including a web and a plurality of ribs, said web forming a resilient tongue providing said top leg latching means and being resiliently movable by said camming face and engageable by said abutment face of said second tray latching means to prevent relative movement of said tray in one direction, the second U-shaped bracket top leg including a web and a plurality of ribs said web forming a resilient tongue providing said top leg latching means and being resiliently movable by said camming face and engageable by said abutment face of said third tray latching means to prevent relative movement of said tray in one direction, and the second U-shaped bracket bottom leg including an intermediate portion and being received in sliding relation between said second tray and said web of said first U-shaped bracket top leg and latching means is provided between said bottom leg intermediate portion and said top leg of said first U-shaped bracket to prevent relative movement of said bracket in one direction.

19. A stackable tray assembly as defined in claim 18, in which:

the intermediate portion of said second bracket bottom leg includes a resilient tongue having latching members thereon providing a camming face an abutment face and the web of said first bracket top leg includes slot means receiving said latching members in latched relation.

20. A stackable tray assembly as defined in claim 19, in which:

the first U-shaped bracket top leg includes stop means engageable with the bottom leg of the second U-shaped bracket to prevent movement in the other direction.

21. A stackable tray assembly as defined in claim 1, in which:

said bight portion of said first U-shaped bracket is rearwardly inclined and the second tray is disposed rearwardly of the first tray.

22. A stackable tray assembly as defined in claim 2, in which:

the bight portion of said second U-shaped bracket is rearwardly inclined and the third tray is disposed rearwardly of the second tray.

23. A stackable tray assembly comprising:

a first tray, a second tray disposed above the first tray, and a U-shaped bracket including a bottom leg, a top leg and a bight portion, 1) said bottom leg being connected to said first tray, 2) said top leg being connected to said second tray, and 3) said bight portion being disposed at one end only of said trays to provide clear access at the other end of said trays and selectively spacing said second tray above said first tray.

24. A stackable tray assembly as defined in claim 23, which:

said first tray includes a front end and a rear end, said second tray includes a front end and a rear end, and said bracket bottom leg is connected to said first tray at the rear end thereof, said bracket top leg is connected to said second tray at the rear end thereof.

* * * * *